United States Patent [19]

Gage et al.

[11] 4,222,331

[45] Sep. 16, 1980

[54] RESILIENT CENTER PLATE ASSEMBLY

[75] Inventors: Paul E. Gage, Wyomissing; Richard O. Church, Reading, both of Pa.

[73] Assignee: The Polymer Corporation, Reading, Pa.

[21] Appl. No.: 958,125

[22] Filed: Nov. 6, 1978

[51] Int. Cl.[3] ..... B61F 5/16; B61F 5/50; F16C 17/04; F16C 33/74

[52] U.S. Cl. ..... 105/199 C; 105/189; 308/137

[58] Field of Search ..... 105/199 C, 189; 308/137

[56] References Cited

U.S. PATENT DOCUMENTS

| | | | |
|---|---|---|---|
| 1,781,253 | 11/1930 | Spencer | 105/199 C X |
| 2,258,640 | 10/1941 | Beckette | 105/199 C X |
| 3,405,654 | 10/1968 | Dilg | 105/199 C |
| 3,466,102 | 9/1969 | Goodwyn | 308/137 |
| 3,944,298 | 3/1976 | Cannon | 105/199 C X |
| 4,075,591 | 2/1978 | Chierici et al. | 105/199 C |
| 4,112,851 | 9/1978 | Rousseau et al. | 105/199 C |

*Primary Examiner*—Howard Beltran
*Attorney, Agent, or Firm*—Richard O. Church

[57] ABSTRACT

A bowl-shaped wear liner for a center plate assembly has an out-turned upper flange that guides the center plate into the center plate bowl during assembly and deforms to seat in sealing relationship with the facing sidewalls of both the center plate and the center plate bowl.

3 Claims, 5 Drawing Figures

RESILIENT CENTER PLATE ASSEMBLY

BACKGROUND OF THE INVENTION

1. Field of the Invention

This invention relates to railroad cars and locomotives and more particularly to a liner adapted to be positioned between the center plate bowl of the truck bolster and the center plate of the body bolster to reduce friction and prevent wear.

2. Description of the Prior Art

It has been recognized that wear between the center plate and the center plate bowl can be reduced by inserting a wear plate or liner between them. In addition to reducing wear, the insert, if made from a nongauling, low friction material, will prevent seizures and enable the truck to rotate relative to the car body more readily.

Various plastic materials have been used as a bearing surface between the center plate and the bowl, including thermosetting materials such as reinforced phenolics, and thermoplastic materials such as nylon; polyesters; low temperature polymerizing, nonelastic polyurethanes; and polyolefins.

The use of ultra-high molecular weight polyethylene to make wear elements in a center plate bowl of a railroad truck is well known and is disclosed, for example, in U.S. Pat. Nos. 3,944,298 and 4,075,951. Also, of background interest, is U.S. Pat. No. 3,405,654 which discloses a center plate liner made from an elastomeric polyurethane.

None of the devices of the prior patent art have the capability of insuring an intimate seal both between the liner and the inside wall of the center plate bowl and between the liner and the outside wall of the center plate. A seal on both sides of the liner is desirable since it will prevent debris from working its way into the center plate assembly that could cause abrasion or other damage to the bearing surfaces.

The device disclosed in U.S. Pat. No. 3,405,654 obtains an effective seal between the rim of the bowl and the bowl liner but not between the liner and the center plate. Further, to achieve a seal in accordance with this patent, the liner must be made from elastomeric materials which generally have high coefficients of friction and do not wear well in bearing applications.

A center plate liner such as shown in U.S. Pat. No. 4,075,951 obtains a seal between the liner and the neck portion of the center plate but does not provide a seal between the liner and the bowl. Further the liner of this patent relies on a freestanding flange which is exposed to damage when the center plate is dropped into position within the bowl.

Accordingly it is an object of this invention to provide a wear resistant center plate liner that will provide an effective seal between the liner and the bowl on the one hand and between the liner and and the center plate on the other hand.

Another object of this invention is to provide a center plate liner that will not be damaged when the center plate is dropped into position but instead will guide the center plate to seat within the center plate bowl.

These and other objects of this invention are achieved by providing a center plate liner in the form of a bowl adapted to be positioned between the facing surfaces, including the floor and sidewalls, of the center plate and the center plate bowl in which the sidewall of the liner carries an upwardly and outwardly directed flange adapted to rest initially upon the rim of the bowl.

The liner is made slightly shallower than the bowl so that when the liner is loosely positioned within the bowl with the flanges of the liner resting on the rim of the bowl, the bottom of the liner is held a small distance above the bottom of the bowl. However, when the center plate is dropped into position and the weight of the car bears against the liner, the liner will be seated in the bottom of the bowl causing the flange on the sidewall of the liner to be deformed or extruded into intimate contact with both the sidewalls of the bowl and the center plate.

The invention can be better understood in connection with the following description of the drawings in which.

Figure 1:
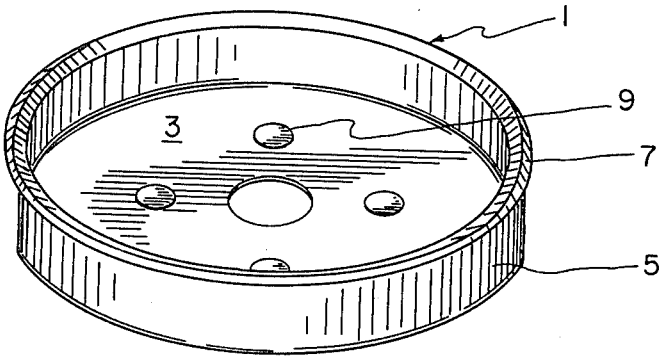
FIG. 1 is a perspective view of a center plate liner made in accordance with this invention.

With reference to FIG. 1, there is shown a center plate liner 1 which is a unitary bowl-shaped structure having a bottom floor 3, an upstanding circumferential wall 5, and an upwardly and outwardly turned flange 7 at the upper free end of the sidewall 5. The liner is made from a nonelastic, rigid, tough plastic having a low coefficient of friction such as, for example, nylon, polyesters, low temperature polymerizing, nonelastomeric polyurethanes, and ultra-high molecular weight polyethylene. Since these materials are nonconductive, metallic plugs 9 are inserted through the wear liner 1 to ground the body bolster through the truck bolster and prevent buildup of static electric charges.

Figure 2:
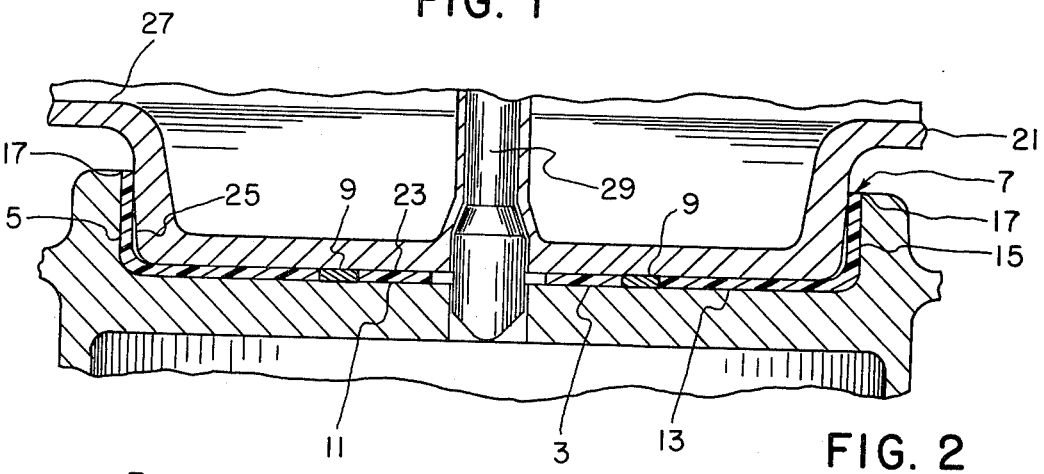
FIG. 2 is a cross-sectional view of a center plate assembly utilizing a liner made in accordance with this invention.

As shown in FIG. 2, the wear liner 1 seats between the facing surfaces of the truck bolster bowl 11 and the body bolster center plate 21. The truck bolster bowl 11 includes a substantially horizontal bottom floor 13 and an upstanding circumferentially positioned sidewall 15 that terminates at a rim 17. While not shown on the drawing, the rim 17 frequently is provided with a quarter round recessed chamfer for welding conventional metal sidewall bearings within the center plate bowl. However, the presence or absence of this quarter round chamfer does not effect the practice of this invention.

The center plate 21 as shown in the drawing has a horizontal bottom surface 23 adapted to rest on the bottom 13 of the bowl 11 and the center plate 21 has an upstanding sidewall 25 which depends from shoulder 27 that is affixed to the body bolster (not shown). To maintain the relative position of the various parts, a kingpin 29 is inserted through the center plate and into the bowl which defines the axis about which the center plate 21 and the bowl 11 rotate relative to each other.

Figure 3A:
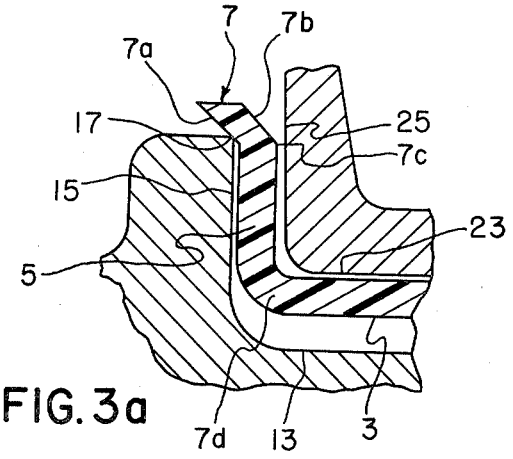
FIGS. 3*a*, 3*b* and 3*c* are schematic views showing in a step-wise fasion the manner in which the objects of this invention are achieved.
Figure 3B:
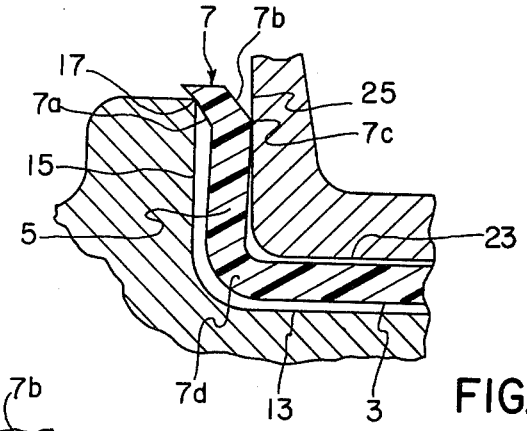
Figure 3C:
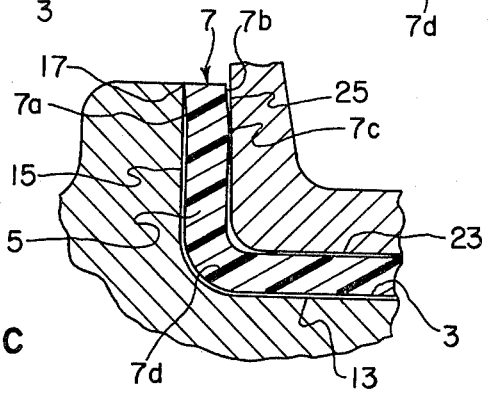

The cooperation of the elements of the center plate assembly in the method of this invention can best be understood by reference to schematic FIGS. 3*a*, 3*b* and 3*c* where the various stages in the installation of the liner between the center plate and the bowl are illustrated. As shown in FIG. 3*a*, the liner has been placed within the bowl 11 and the outwardly and upwardly turned flange 7 rests against the rim 17 of the bowl 11. Since the height of the sidewall 5 of the liner 1 is less than the height of the sidewall 15 of the bowl 11, the bottom 3 of the liner 1 is held suspended above the floor 13 of the bowl 11. In FIG. 3*b*, the center plate 21 has been lowered into contact with the bottom 3 of the liner 1 and has begin to force it into seating relationship with the bottom 13 of the bowl 11. As the liner 1 is forced downwardly into the space between the plate and the bowl, the outer face *7a* of the flange 7 rides down the rim 17 of the bowl 11 and forces the inner shoulder *7c* of the liner 1 into intimate contact with the sidewall 25 of the center plate 21. At this time, the inner shoulder *7c* of the liner 1 is seated in intimate contact with the sidewall 25 of the plate 21 and, at the same time, the outer face *7a* of the flange 7 is seated in intimate contact with the rim 17 of the bowl 11. This described movement of the flange 7 into contact with the plate 21 is occasioned by the sidewall 5 of the liner 1 bending at the center point *7d* of the intersection of the sidewall 5 and the bottom wall 3 of the liner 1.

FIG. *3c* illustrates the relationship of the liner 1 and the mating surfaces of the bowl 11 of the center plate 21 after the center plate has been fully seated within the bowl 11. Here it can be seen that the flange 7 has been extruded down into the space between the sidewalls of the bowl 15 and the plate 25 so that the upper surface of the flange 7 is at or below the rim 17 of the bowl 11. It will be appeciated that by extruding the liner 1 into the space between the center plate 21 and the bowl 11, a substantial seal is formed between the various elements of the assembly.

It is also pointed out that the liner designed in accordance with this invention can act as a guide, or "shoe horn" to help position the center plate in registry with the center plate bowl. This is another function of the upwardly and out-turned flange 7 of the liner 1. Note that when the liner is first laid in the bowl 11, the flange 7 rests securely against and is supported by the rim of the bowl 17 so that if there is any mis-alignment when the center plate is dropped into position, it will not cause damage to the flange 7 of the bowl 1.

As previously mentioned, there may be a small recessed chamfer at rim 17 of the bowl 11, but, in this case, the outer face *7a* of the liner 1 will seat effectively against the edge of chamfer rather than against the rim 17.

I claim:

1. A center plate assembly for permitting relative rotational movement about a vertical axis between a truck and car body including:

a truck bolster upon which is mounted an upturned horizontally disposed center plate bowl having an inner diameter;

a body bolster from which depends a horizontally disposed center plate having an outer diameter that is seated for rotation within the center plate bowl; and a bowl-shaped wear liner disposed between facing bottom and sidewall surfaces of the center plate bowl and the center plate;

characterized in that inside and outside sidewall surfaces of the liner terminates in an outwardly and upwardly turned flange which is held between the bowl and the center plate with a discrete annular portion of the outside surface of the flange seated against the inner diameter of the center plate bowl and a discrete annular portion of the inside surface of the flange seated against the outer diameter of the center plate.

2. A center plate assembly according to claim 1 wherein the center plate bowl is made from at least one of nylon, polyester, nonelastomeric thermoplastic polyurethane, and ultra-high molecular weight polyethylene.

3. A method for assembling a wear liner in sealing engagement between the sidewall of a truck bolster bowl and the sidewall of a body bolster center plate which comprises:

positioning a bowl-shaped wear liner with a vertical sidewall terminating in an upwardly and outwardly turned flange within the bolster bowl with the flange of the wear liner resting upon the rim of the bowl to hold the bottom of the liner a slight distance above the bottom of the bowl;

positioning the center plate over the liner;

lowering the center plate into the liner to force the liner to seat in the bottom of the bowl;

whereby a discrete portion of the inside surface of the flange of the liner is deformed into intimate contact with the sidewall of the center plate and a discrete portion of the outside surface of the flange of the liner is deformed into intimate contact with the sidewall of the bowl.

* * * * *